US005185088A

United States Patent [19]

Hartman et al.

[11] Patent Number: 5,185,088

[45] Date of Patent: Feb. 9, 1993

[54] GRANULAR FABRIC SOFTENER COMPOSITIONS WHICH FORM AQUEOUS EMULSION CONCENTRATES

[75] Inventors: Frederick A. Hartman; Donald R. Brown; John R. Rusche, all of Cincinnati; Lucille F. Taylor, West Chester, all of Ohio

[73] Assignee: The Procter & Gamble Company, Cincinnati, Ohio

[21] Appl. No.: 689,406

[22] Filed: Apr. 22, 1991

[51] Int. Cl.[5] ..... D06M 10/08

[52] U.S. Cl. ..... 252/86; 252/8.7; 252/8.8; 252/8.9

[58] Field of Search ..... 252/8.6, 8.7, 8.8, 8.9

[56] References Cited

U.S. PATENT DOCUMENTS

| | | | |
|---|---|---|---|
| 3,256,180 | 6/1966 | Weiss | 252/8.8 |
| 3,351,483 | 11/1967 | Miner et al. | 117/66 |
| 3,546,115 | 12/1970 | Gill et al. | 252/8.8 R |
| 4,126,562 | 11/1978 | Goffinet et al. | 252/8.8 |
| 4,128,484 | 12/1978 | Barford et al. | 252/8.8 |
| 4,151,097 | 4/1979 | Nelson | 252/8.6 |
| 4,152,272 | 5/1979 | Young | 252/8.8 |
| 4,162,984 | 7/1979 | DeBlock et al. | 252/8.8 |
| 4,237,016 | 12/1980 | Rudkin et al. | 252/8.8 |
| 4,264,457 | 4/1981 | Beeks et al. | 252/8.75 |
| 4,268,401 | 5/1981 | Meschkat et al. | 252/8.8 |
| 4,328,110 | 5/1982 | Green | 252/8.75 |
| 4,401,578 | 8/1983 | Verbruggen | 252/8.8 |
| 4,421,657 | 12/1983 | Allen et al. | 252/8.6 |
| 4,426,299 | 1/1984 | Verbruggen | 252/8.6 |
| 4,443,363 | 4/1984 | Klinger et al. | 252/547 |
| 4,464,271 | 8/1984 | Munteanu et al. | 252/8.9 |
| 4,469,606 | 9/1984 | Reid et al. | 252/8.9 |
| 4,514,444 | 4/1985 | Ives et al. | 252/8.8 |
| 4,589,989 | 5/1986 | Muller et al. | 252/8.75 |
| 4,711,730 | 12/1987 | Gosselink et al. | 252/8.8 |
| 4,726,908 | 2/1988 | Kruse et al. | 252/8.8 |
| 4,762,645 | 8/1988 | Tucker et al. | 252/8.8 |
| 4,828,746 | 5/1989 | Clauss et al. | 252/8.8 |
| 4,894,117 | 1/1990 | Bianchi et al. | 252/8.6 |
| 4,968,443 | 11/1990 | Lambert et al. | 252/534 |

FOREIGN PATENT DOCUMENTS

WO88/00990 2/1988 PCT Int'l Appl. .

*Primary Examiner*—A. Lionel Clingman
*Assistant Examiner*—William S. Parks
*Attorney, Agent, or Firm*—Robert B. Aylor

[57] ABSTRACT

A granular fabric softening composition, which can be added to water to form an aqueous concentrated emulsion, comprising nonionic fabric softener, preferably a fatty alkyl ester of a polyhydric alcohol, and a mono-long-chain alkyl cationic surfactant. In particular, the use of a sorbitan ester with a mono-long-chain alkyl cationic surfactant provides a granular softening agent which can be used to form a highly dispersed, concentrated, aqueous composition which, when added to, e.g., a rinse cycle of a typical washing process, effectively deposits onto fabric from the aqueous bath.

18 Claims, No Drawings

GRANULAR FABRIC SOFTENER COMPOSITIONS WHICH FORM AQUEOUS EMULSION CONCENTRATES

BACKGROUND OF THE INVENTION

This invention relates to fabric softening compositions and, in particular, to granular compositions which readily form aqueous emulsions and/or dispersions when added to water.

It has long been recognized that certain chemical compounds have the capability of imparting softness to textile fabrics. These compounds, which are known generally as "softening agents," "fabric softeners," or "softeners," have been used both by the textile industry and by housewives in the laundry to soften a finished fabric, thereby making the fabric smooth, pliable and fluffy to handle. In addition to the quality of softness, the fabrics frequently have a reduced tendency to static cling and are easier to iron.

The softening agents which are usually employed in compositions intended for use by the individual consumer are cationic surfactant compounds, commonly quaternary ammonium compounds having at least two long alkyl chains, for example, distearyl dimethyl ammonium chloride. The positive charge on the softening compound encourages its deposition onto the fabric substrate, the surface of which is usually negatively charged.

However, although the above-mentioned cationic compounds are highly effective softeners when applied in a rinse solution, they cannot be supplied in a granular form which will readily disperse to form concentrated aqueous emulsions/dispersions of the type typically employed by the individual consumer. Granules containing cationic compounds having long alkyl chains tend to form highly viscous/non-dispersible phases rather than dispersions when added to water. The present invention provides granular softening compositions, which employ nonionic softeners, which compositions provide excellent deposition onto the fabric surface from dilute aqueous solution, and which, surprisingly, can be used to form aqueous concentrated emulsions/-dispersions of the type used by individual consumers by simply mixing with tap water. The compositions are sold in granular form and used by the consumer to form typical aqueous, liquid, rinse-added fabric softener compositions of the general type disclosed in U.S. Pat. Nos.: 4,128,484, Barford and Benjamin, for Fabric Softening Compositions, issued Dec. 5, 1978; and 4,126,562, Goffinet and Leclercq, for Textile Treatment Compositions, issued Nov. 21, 1978; said patents being incorporated herein by reference. Such granular compositions provide a large environmental advantage versus existing liquid products since the granular products can be packaged in cardboard cartons that are essentially biodegradable rather than in plastic bottles which are more slowly degradable.

DESCRIPTION OF THE PRIOR ART

Various ethoxylated alcohols are further known to be useful in textile lubricating compositions (See U.S. Pat. No. 3,773,463, Cohen et al. issued Nov. 20, 1973).

The use of various sorbitan ester compounds, or derivatives, to treat fabrics is known (See Atlas Powder Company Bulletin No. 9, "Industrial Emulsions with Atlas Surfactants," 1953; U.S. Pat. Nos.: 4,261,043, Eisen, issued Feb. 8, 1949; 2,665,443, Simon et al., issued Jan. 12, 1954; 3,652,419, Karg, issued Mar. 28, 1972; and 3,827,114, Crossfield, issued Aug. 6, 1974).

U.S. Pat. No. 3,793,196, Okazaki and Miamura, issued Feb. 19, 1974, relates to a softening composition in emulsion form, the active softening ingredients being a quaternary ammonium salt and a higher alcohol, and a nonionic emulsifier system comprising sorbitan fatty acid ester and a polyoxyethylene alkyl ether being used to stabilize and adjust the viscosity of the emulsion.

U.S. Pat. No. 2,735,790, Waitkus, issued Feb. 21, 1956, discloses a relatively complex, four-component system including nonionic esters and a specific type of quaternary ammonium compound, the system being useful for treating polyacrylonitrile fibers.

U.S. Pat. Nos. 4,085,052, Murphy et al., issued Apr. 18, 1978; and 4,022,938, Zaki et al., issued May 10, 1977, relate to articles for addition to a clothes dryer, the articles being impregnated with or otherwise containing sorbitan esters, or mixtures of sorbitan esters with cationic compounds.

U.S. Pat. No. 4,395,342, Strauss, issued Jul. 26, 1983, discloses solid fabric softener compositions for additon to a rinse cycle in a wash process.

All of the above patents are incorporated herein by reference.

SUMMARY OF THE INVENTION

The present invention is based on the discovery that certain nonionic fabric softeners, such as sorbitan esters, when homogeneously combined with certain single-long-chain alkyl cationic surfactant compounds in the form of particles, e.g., granules, can be added to water by an individual consumer to form an effective concentrated aqueous emulsion/dispersion for softening fabrics. Such homogeneous granules containing appropriate nonionic softener and appropriate cationic compound can be readily emulsified/dispersed together when mixed with water. E.g., such compositions can be formulated to be dispersible in water having a temperature of no more than about 80° C. within about thirty minutes to form a concentrated dispersion, as described hereinafter, having particle sizes no greater than about 10 microns.

Although the granules can be added directly to, e.g., rinse water to form a dilute treatment bath for fabrics, the compositions are much more effective when used to fabricate an aqueous concentrate. At low water temperatures, it can take up to fifteen minutes to form the desired dilute small particle size emulsion/dispersion, which is typically longer than the rinse cycle in an ordinary automatic laundry machine.

The particle size (diameter) of the granules should be between about 50 and about 1000 microns, preferably between about 50 and about 400 microns, to have good properties relative to forming an aqueous concentrate. Very small emulsion/dispersion particles are formed, in the aqueous concentrates, which particles have a suitable positive charge distribution on their outer surface for good deposition onto fabrics.

According to the present invention, a softening composition is provided in the form of granules which, when added to water, inherently form an aqueous concentrate emulsion/dispersion, the particles of the disperse phase preferably being characterized by an average particle size of less than about 5 microns in diameter. Said granules preferably consist essentially of at least about 25% of nonionic fabric softener, which is preferably a fatty acid partial ester of a polyhydric alcohol, or anhydride thereof, said alcohol or anhydride thereof typically containing from 2 to about 12 carbon atoms and at least about 5% of a mono-long-chain alkyl cationic surfactant.

In highly preferred embodiments of the invention, the mono-long-chain alkyl cationic surfactant includes a quaternary ammonium salt having an alkyl chain with from about 12 to about 22 carbon atoms. Some preferred embodiments can additionally include a cationic material having two $C_{12}$–$C_{30}$ alkyl chains.

DETAILED DESCRIPTION OF THE INVENTION

The composition of the present invention comprises components which are described more fully hereinafter. All percentages, ratios, and parts herein are by weight, unless otherwise specified.

The Nonionic Softener

The essential softening agent of the present invention is a nonionic fabric softener material. Typically, such nonionic fabric softener materials have an HLB of from about 2 to about 9, more typically from about 3 to about 7, since such nonionic fabric softener materials tend to be more readily dispersed either by themselves, or when combined with other materials as set forth hereinafter by the single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., $> \sim 50°$ C.) and relatively water-insoluble.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters are particularly preferred.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

The most highly preferred groups of softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing type of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society*, Vol. 45, October 1968.

Details, including formulae, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified -OH groups contain one to about twenty oxyethylene moieties [Tweens®] are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10-35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises ca. 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan mono-myristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol esters, especially glycerol mono- and/or diesters, are also preferred herein. Such esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some mono- and tri-ester, etc.

The performance of, e.g., glycerol mono-esters is improved by the addition of a di-long chain cationic material as described hereinafter.

The "glycerol esters" also include the polyglycerol, e.g., di-, tri-, tetra-, penta-, and/or hexaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Still other desirable "nonionic" softeners are ion pairs of anionic detergent surfactants and fatty amines, or quaternary ammonium derivatives thereof, e.g., those disclosed in U.S. Pat. No. 4,756,850, Nayar, issued Jul. 12, 1988, said patent being incorporated herein by reference. These ion pairs act like nonionic materials since they do not readily ionize in water. They typically contain at least about two long hydrophobic groups (chains).

Generically, the ion pairs useful herein are formed by reacting an amine and/or a quaternary ammonium salt containing at least one, and preferably two, long hydrophobic chains ($C_{12}$–$C_{30}$, preferably $C_{11}$–$C_{20}$) with an anionic detergent surfactant of th types disclosed in said U.S. Pat. No. 4,756,850, especially at Col. 3, lines 29–47. Suitable methods for accomplishing such a reaction are also described in U.S. Pat. No. 4,756,850, at Col. 3, lines 48–65.

The equivalent ion pairs formed using $C_{12}$–$C_{30}$ fatty acids are also desirable. Examples of such materials are known to be good fabric softeners as described in U.S. Pat. 4,237,155, Kardouche, issued Dec. 2, 1980, said patent being incorporated herein by reference.

Ion pairs are highly desirable nonionic fabric softener materials since they tend to disperse readily, are excellent at dissipating charge, and tend to be crystalline for improved particle flowability and package compatibility.

Other fatty acid partial esters useful in the present invention are ethylene glycol distearate, propylene glycol distearate, xylitol monopalmitate, pentaerythritol monostearate, sucrose monostearate, sucrose distearate, and glycerol monostearate. As with the sorbitan esters, commercially available mono-esters normally contain substantial quantities of di- or tri- esters.

Still other suitable nonionic fabric softener materials include long chain fatty alcohols and/or acids and esters thereof containing from about 16 to about 30, preferably from about 18 to about 22, carbon atoms, esters of such compounds with lower ($C_1$–$C_4$) fatty alcohols or fatty acids, and lower (1–4) alkoxylation ($C_1$–$C_4$) products of such materials.

These other fatty acid partial esters, fatty alcohols and/or acids and/or esters thereof, and alkoxylated alcohols and those sorbitan esters which do not form optimum emulsions/dispersions can be improved by adding other di-long-chain cationic material, as disclosed hereinafter, or other nonionic softener materials to achieve better results.

The above-discussed nonionic compounds are correctly termed "softening agents,," because, when the compounds are correctly applied to a fabric, they do impart a soft, lubricious feel to the fabric. However, they require a cationic material if one wishes to apply such compounds from a dilute, aqueous rinse solution to fabrics. Good deposition of the above compounds is achieved through their combination with certain cationic surfactants which are discussed in greater detail below. The fatty acid partial ester materials are preferred for biodegradability and the ability to adjust the HLB of the nonionic material in a variety of ways, e.g., by varying the distribution of fatty acid chain lengths, degree of saturation, etc., in addition to providing mixtures. The level of nonionic softener in the granule is typically from about 20% to about 95%, preferably from about 50% to about 85%, more preferably from about 60% to about 80%.

The Single-Long-Chain Alkyl Cationic Surfactant

The essential mono-long-chain alkyl cationic surfactants useful in the present invention are preferably quaternary ammonium salts of the general formula $R_1R_2R_3R_4N\oplus X\ominus$, and the corresponding mono-long-chain alkyl unquaternized amines, wherein groups $R_1$, $R_2$, $R_3$, $R_4$ are, for example, alkyl or substituted (e.g., hydroxy) alkyl, and X is an anion, for example, chloride, bromide, methyl sulfate, etc.

The long chain typically contains from about 12 to about 30 carbon atoms, preferably from about 16 to about 22 carbon atoms, and can be interrupted with one, or more, ester, amide, ether, amine, etc., linking groups which can be desirable for increased hydrophilicity, biodegradability, etc. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If amines are used, an acid (preferably a mineral or polycarboxylic acid) is added to keep the amine protonated in the compositions and preferably during the rinse, the composition may be buffered (pH from about 2 to about 5, preferably from about 2 to about 3) to maintain an appropriate, effective charge density in the aqueous liquid concentrate product and upon further dilution e.g., upon addition to the rinse cycle of a laundry process.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

It will be understood that the main function of the cationic surfactant is to encourage deposition of softener and it is not, therefore, essential that the cationic surfactant itself have substantial softening properties, although this may be the case. Indeed, it is essential that at least a part of the cationic component of the composition comprises a surfactant having only a single long alkyl chain, as such compounds, presumably because they have greater solubility in water, can more effectively provide the appropriate positive charge distribution and the degree of hydration on the surface of the emulsified/dispersed nonionic softener particle.

Thus, it is essential that at least a portion of the cationic surfactant have a single $C_{12}$–$C_{22}$, preferably $C_{14}$–$C_{18}$, alkyl group.

Preferred cationic surfactants are the quaternary ammonium salts of the general formula:

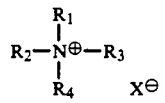

wherein group $R_1$ is $C_{12}$–$C_{22}$, preferably $C_{16}$–$C_{18}$ fatty alkyl group or the corresponding ester linkages interrupted group, e.g., a fatty acid ester of choline, and groups $R_2$, $R_3$ and $R_4$ are each $C_1$–$C_4$ alkyl, preferably methyl, and the counterion X is as above.

Alkyl imidazolinium salts useful in the present invention have cations of the general formula:

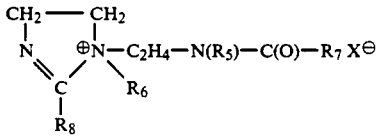

wherein $R_5$ is hydrogen or a $C_1$–$C_4$ alkyl radical; $R_6$ is a $C_1$–$C_4$ alkyl radical; $R_7$ is a $C_8$–$C_{25}$ alkyl radical; and $R_8$ is either a $C_1$–$C_4$ or a $C_8$–$C_{25}$ alkyl radical (depending upon whether the compound is a single-long-chain alkyl cationic or a di-long-chain alkyl cationic discussed hereinafter).

Alkyl pyridinium salts useful in the present invention have cations of the general formula:

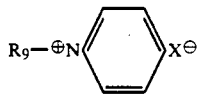

wherein $R_9$ is a $C_{12}$–$C_{20}$ alkyl radical. A typical material of this type is cetyl pyridinium chloride.

Also useful in the present invention are di- or poly-cationic materials, e.g., diquaternary ammonium salts, of the above general formula, having the formula:

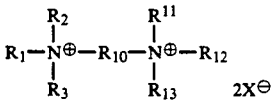

wherein group $R_1$ is $C_{12}$–$C_{20}$ fatty alkyl, preferably $C_{16}$–$C_{18}$ alkyl, groups $R_2$ and $R_3$ are each $C_1$–$C_4$ alkyl, preferably methyl, and $R_4$ is the group $R_{10}$, $R_{11}$, $R_{12}$, $R_{13}$, $N\oplus$, $X\ominus$ wherein $R_{10}$ is $C_2$–$C_8$, preferably $C_3$–$C_4$, alkylene; $R_{11}$, $R_{12}$ and $R_{13}$ are each $C_1$–$C_4$ alkyl, preferably methyl; and X is an anion, for example, a halide. Other poly-cationic materials are the ones described in U.S. Pat. No. 4,022,938, incorporated hereinbefore by reference.

These poly-cationic, e.g., diquaternary ammonium, salts can, in certain circumstances, provide additional positive charge at the emulsion/dispersion particle surface, and thereby improve deposition.

The conventional quaternary ammonium softening agents having formulae similar to the formulae of the single-long-chain alkyl cationic surfactants, but which contain two $C_{12}$–$C_{20}$ fatty alkyl groups, function to a certain extent in the same way as the essential mono-long-chain alkyl compounds. In the present invention, however, such softening agents are only used in conjunction with the essential mono-long-chain alkyl cationic surfactants.

In many cases, it is advantageous to use a 3-component composition comprising nonionic softener, mono-long-chain alkyl cationic surfactant such as fatty acid choline ester, cetyl trimethylammonium bromide, etc., and di-long-chain alkyl cationic softener such as ditallowdimethylammonium chloride or ditallowmethyl amine salt. The additional cationic softener, as well as providing additional softening power and improving performance of nonionic softeners which do not provide optimum performance, also acts as a reservoir of additional positive charge, so that any anionic surfactant which is carried over into the rinse solution from a conventional washing process is effectively neutralized and does not upset the positive charge distribution on the surface of the emulsified nonionic softener particles. The di-long-chain alkyl cationic softener also improves performance, the rate at which the dispersion/suspension forms, and the concentration that can be achieved in the dispersed composition.

Optional Ingredients

Adjuvants can be added to the composition herein at usual levels for their known purposes. Such adjuvants include emulsifiers, perfumes, preservatives, germicides, viscosity modifiers, colorants, dyes, fungicides, stabilizers, brighteners, and opacifiers. These adjuvants, if used, are added at their conventional low levels (e.g., from about 0.5% to about 5% by weight). The present compositions should not, of course, contain large amounts of any material (e.g., anionics) which chemically interferes with the functioning of the essential composition components.

Composition Formulation

The compositions of the present invention are in the form of granules, and the particles must comprise at least 20% of the nonionic softener and at least 5% of the cationic surfactant. The level of nonionic softener is from about 20% to about 95%, preferably from about 50% to about 85%, more preferably from about 60% to about 80%. The level of essential mono-long-chain alkyl cationic surfactant is typically from about 5% to about 50%, preferably from about 10% to about 35%, more preferably from about 15% to about 30%. The ratio of nonionic softener to mono-long-chain alkyl surfactant is typically from about 12:1 to about 1:1, preferably from about 9:1 to about 2:1, more preferably from about 5:1 to about 2:1.

Also, the emulsified/dispersed particles, formed when the granules are added to water to form aqueous concentrates, must have an average particle size of less than about 10 microns, preferably less than about 2 microns, and more preferably from about 0.25 to about 1 micron, in order that effective deposition onto fabrics is achieved. The term "average particle size," in the context of this specification, means a number average particle size, i.e., more than 50% of the particles have a diameter less than the specified size. In highly preferred embodiments of the invention, substantially all (i.e., at least about 80%) of the granules comprises the above-discussed two components, namely (a) the nonionic softener and (b) one or more single-long-chain alkyl cationic surfactants. However, it is possible for the granules to include other non-interfering components, for example, other nonionic softeners and/or di-long-chain alkyl cationic, so long as the HLB of the nonionic softener mixture is within the desired limits and the overal dispersibility is maintained. Such other components can form a substantial portion of the disperse phase after incorporation of the essential components discussed above into water.

Two types of softening compositions are particularly preferred in the present invention and these will be discussed separately below.

The first type has a substantially two-component formula in which from about 50% to about 95%, preferably from about 65% to about 80%, of nonionic softener, preferably sorbitan ester, is combined with from about 5% to about 50%, preferably from about to about 35%, of mono-long-chain alkyl cationic surfactant, preferably one of the formula $R_1R_2R_3R_4N\oplus X\ominus$ wherein $R_1$ is $C_{12}$–$C_{30}$ alkyl containing an optional ester or amide linkage, $R_2$, $R_3$ and $R_4$ are each H, $C_1$–$C_4$ alkyl or hydroxyalkyl, preferably methyl, and X is an anion, preferably chloride, bromide or methyl sulfate.

The compositions of the above type provide very effective softening compositions at relatively low levels of cationic surfactants, and these compositions are therefore especially preferred.

The second type of preferred composition employs a three-component disperse phase comprising nonionic softener, preferably sorbitan ester, cationic surfactant having a single long alkyl chain and cationic surfactant having two long alkyl chains. Preferred mono-long-chain alkyl cationic surfactants are choline, esters of fatty alcohols containing from about 10 to about 22, preferably from about 12 to about 18, carbon atoms; $C_{12}$–$C_{22}$ (preferably $C_{16}$–$C_{18}$) alkyl trimethylammonium chlorides, bromides, methyl sulfates, etc. Varisoft® 110, 222, 445 and 475; Adogen® 442 and 470; ditallowalkylmethyl amine; and (bis-$C_{16}$–$C_{18}$ alkyl carboxymethyl)methyl amine are preferred di-long-chain alkyl cationic surfactants. Preferred compositions of this type comprise from about 20% to about 80%, preferably from about 50% to about 75%, of nonionic; from about 5% to about 30%, preferably from about 15% to about 25%, of mono-long-chain alkyl cationic; and from about 10% to about 65%, preferably from about 15% to about 40%, of di-long-chain alkyl cationic surfactant.

In the case of the three-component mixture, it is more preferred, when forming the granules, to pre-mix the nonionic softener and the more soluble (i.e., single alkyl chain) cationic compound before mixing in a melt of the di- alkyl cationic compound. This procedure leads to granules that provide an aqueous emulsion having particles of an average size of less than 4 microns, the particles being positively charged at their surface. Depending upon the particular selection of nonionic softener and cationic surfactant, it may be necessary in certain cases to include other emulsifying ingredients (e.g., common ethoxylated alcohol nonionics) or to employ more efficient means for dispersing and emulsifying the particles (e.g., blender).

The granules can be formed by preparing a melt, solidifying it by cooling, and then grinding and sieving to the desired size. It is highly preferred that the particles of the granules have a diameter of from about 50 to about 1,000, preferably from about 50 to about 400, more preferably from about 50 to about 100, microns. The granules may comprise smaller and larger particles, but preferably from about 85% to about 95%, more preferably from about 95% to about 100%, are within the indicated ranges. Smaller and larger particles do not provide optimum emulsions/dispersions when added to water.

Other methods of preparing granules can be used including spray cooling.

The flowability of the granules can be improved by treating the surface of the granules with flow improvers such as clay, silica or xeolite particles, water-soluble inorganic salts, starch, etc.

Granular compositions of the above types are used in a simple way by mixing the ingredients into water at a concentraion of from about 2% to about 30%, preferably from about 5% to about 15%, and water temperatures of from about 20° C. to about 80° C., preferably from about 25° C. to about 45° C., and, preferably, agitating for from about 1 to about 30 minutes, preferably from about 1 to about 5 minutes.

The compositions are desirably packaged in cardboard boxes, but it can be desirable to add liquid/vapor barrier laminates to the cardboard or to use plastic bottles.

Normally, the granules containing the softening agents readily form true concentrated emulsions/dispersions with an aqueous continuous phase when added to water. The temperature of the water can vary from about 20° C. to about 80° C., preferably from about 35° C. to about 45° C. The resulting disperse phase can be wholly or partially solid, so that the final aqueous liquid concentrated composition can exist as a dispersion which is not a true liquid/liquid emulsion. It will be understood that the term "dispersion" means liquid/liquid phase or solid/liquid phase dispersions and/or emulsions.

For normal use as rinse-added aqueous liquid concentrated compositions, the disperse phase, provided by the granules, comprises from about 2% to about 30%, preferably from about 5% to about 15%, of the aqueous composition. The resulting aqueous compositions of the present invention are, in turn, normally used at about 0.05–0.5%, preferably from about 0.1% to about 0.5%, concentration in the rinse cycle of a washing machine to give an effective concentration of active softening agent of from about 50 to about 1,000, preferably from about 100 to about 500, ppm.

All percentages, ratios, and parts herein are by weight unless otherwise specified. All numbers in limits, ratios and numerical ranges, etc., herein are approximate, unless otherwise specified.

The following exemplifies the fabric softening compositions of the present invention and the benefits obtained by using such compositions.

| | (Wt. % of Solid Composition) | | | | |
|---|---|---|---|---|---|
| EXAMPLE: | I | II | III | IV | V |
| Cetyltrimethylammonium Bromide (CTAB) | 22.9 | — | — | — | — |
| Lauroylcholine Chloride (LCC) | — | 17 | — | 25 | — |
| Myristoylcholine Chloride (MCC) | — | — | 17 | — | — |
| Cetylpyridinium Chloride | — | — | — | — | 25 |
| Sorbitan Monostearate (SMS) | 68.2 | — | — | — | 75 |

-continued

| EXAMPLE: | (Wt. % of Solid Composition) I | II | III | IV | V |
|---|---|---|---|---|---|
| Glycerol Monostearate (GMS) | — | — | 50 | 56 | — |
| Sucrose Distearate (SuDS) | — | 50 | — | — | — |
| Triglycerol Distearate (TGDS) | — | — | — | 19 | — |
| Ditallowalkylmethyl Amine | — | 33 | 33 | — | — |
| Perfume | 3.3 | | | | |
| Porous Silica | 5.7 | | | | |

EXAMPLE PREPARATION

Example I

A homogeneous mixture of cetyltrimethylammonium bromide (CTAB) and sorbitan monostearate (SMS) is obtained by melting SMS (82.5 g) and mixing CTAB (27.5 g) therein. The solid softener product is prepared from this "co-melt" by one of two methods: (a) cryogenic gringing (−78° C.) to form a fine powder, or (b) prilling to form 50–500 μm particles.

Cryogenic Grinding

The molten mixture is frozen in liquid nitrogen and ground in a Waring blender to a fine powder. The powder is placed in a dessicator and allowed to warm to room temperature, yielding a fine, free flowing powder (granule).

Prilling

The molten mixture (~88° C.) falls ~1.5 inches at a rate of about 65 g/min. onto a heated (~150° C.) rotating (~2,000 rpm) disc. As the molten material is spun off the disk and air cooled (as it radiates outward), near-spherical granule particles (50–500 μm) form.

The solid particles are dispersed in warm water (40° C., 890 g) and vigorously shaken for approximately 1 minute to form a conventional liquid fabric softener product. Upon cooling, the aqueous product remains in a homogeneous emulsified, or dispersed, state. Addition of the liquid product to the rinse cycle of a washing process provides excellent softness, substantivity, and antistatic characteristics.

The solid softener actives are also reconstituted in cooler water (e.g., 20° C.) by providing vigorous agitation and sufficient time (3–4 hours) to disperse. Liquid products prepared in this way deliver softness, substantivity, and antistatic benefits comparable to those prepared with warmer water.

The complete perfumed solid softener product of Example I is prepared by mixing the preformed "perfumed silica" described below with the above solid softener actives. Perfume is loaded onto porous silica and subsequently admixed with the powdered (or prilled) softener actives. (The "perfumed silica" is first prepared by mixing 2.1 parts porous silica into a molten premix comprised of 3 parts SMS, 1 part CTAB, and 1.2 parts perfume.) The complete perfumed softener product (Example I) is reconstituted in water as described above for the perfume-free material.

Example II 13.1 g of citric acid and 3.1 g of potassium citrate are added to 36.3 g of molten ditallowmethyl amine to form a premix. Lauroylcholine chloride (18.7) and sucrose distearate (55 g) are mixed therein to form a thick brown paste. The paste is cryogenically ground to a fine, free-flowing powder (~50–500 microns in diameter). The powdered softener granule composition is reconstituted in warm water as described for Example I. Addition of this liquid fabric softening product to the rinse cycle of a washing process delivers softness, static control, and substantivity benefits to fabrics.

Example III

Following the procedure outlined in Example II, 13.1 g of citric acid, 3.1 g of potassium citrate, 18.7 g of myristoylcholine, and 55 g of GMS are stirred into 36.3 g of molten ditallowmethyl amine to form a creamy white paste. The paste is cryogenically ground into a fine, free-flowing powder (~50–500 microns in diameter). A liquid dispersion of this product is prepared by adding hot (60° C., 890 g) water to the powdered softener actives and vigorously shaking for approximately 1 minute. Softness, static control, and substantivity benefits are comparable to, or better than, those of Example II.

Example IV 27.4 g of lauroylcholine is stirred into a co-melt containing 61.6 g of GMS and 21.0 g of triglycerol distearate. The mixture is cryogenically ground as described in Example I. The solid product is reconstituted in 890 g of 40° C. water to form a liquid dispersion which delivers excellent softening and antistatic benefits to fabrics when added to the rinse cycle of a wash process.

Example V

Following the procedure of Example I, a homogeneous mixture of cetylpyridinium chloride (27.5 g) and molten SMS (82.5 g) is prepared and cryogenically ground to a fine white powder (~50–500 microns in diameter). The solid softener composition readily disperses in warm (40° C.) water to yield a liquid rinse-added fabric softener which provides excellent softness, substantivity, and static control benefits to clothes.

What is claimed is:

1. Solid granular fabric softener composition which forms a finely divided dispersion within about thirty minutes when added to water having a temperature of no more than about 80° with minimal agitation, said composition comprising homogeneous particles containing:

A. from about 20% to about 95% of nonionic fabric softener material, wherein said nonionic fabric softener material is selected from the group consisting of:

i. Fatty acid ester of polyhydroxy alcohol, or anhydride thereof, said alcohol containing from 2 to about 18 carbon atoms and said fatty acid contains from about 12 to about 30 carbon atoms;

ii. Ion pair of anionic detergent surfactants and fatty amines, or quaternary ammonium derivatives thereof, said ion pair being essentially nonionic and containing at least two long hydrophobic chains;

iii. Fatty alcohols, fatty acids, or lower alkoxylates or esters thereof wherein the fatty moiety contains from about 16 to about 30 carbon atoms; and iv. Mixtures thereof; and B. from about 5% to about 50% of a material that is cationic under conditions of use at dilute concentrations of said composition, said cationic material having a single long alkyl chain containing from about 12 to about 30 carbon atoms.

2. The composition of claim 1 wherein said granular composition has an average particle diameter of between about 50 and about 1,000 microns.

3. The composition of claim 2 wherein said particle diameter is between about 50 and about 400 microns.

4. The composition of claim 1 consisting essentially of from about 20% to about 80% of said A., from about 5% to about 30% of said B., and from about 10% to about 65% of compatible di-long chain alkyl cationic material.

5. The composition of claim 4 wherein said di-long chain alkyl cationic material is an amine containing two long alkyl chains containing from about 12 to about 20 carbon atoms and a short alkyl or hydroxy alkyl chain containing from one to about 4 carbon atoms.

6. The composition of claim 1 wherein said nonionic fabric softener is a fatty acid ester of polyhydroxy alcohol, or anhydride thereof, where said alcohol contains from 2 to about 18 carbon atoms; said fatty acid contains from about 12 to about 30 carbon atoms: and there are from one to about three fatty acid moieties per ester molecule on the average.

7. The composition of claim 6 wherein said nonionic fabric softener is a sorbitan partial ester and said fatty acid contains from about 16 to about 20 carbon atoms.

8. The composition of claim 1 wherein said nonionic fabric softener is a fatty acid mono-, di-, or tri- partial ester of polyhydroxy alcohol, or anhydride thereof, where said alcohol contains from 2 to about 12 carbon atoms and said fatty acid contains from about 12 to about 30 carbon atoms.

9. The composition of claim 8 wherein said nonionic fabric softener is a glycerol partial ester and said fatty acid contains from about 16 to about 20 carbon atoms.

10. The composition of claim 1 wherein said nonionic fabric softener is a fatty acid ester of a dihydroxy alcohol and said fatty acid contains from about 12 to about 30 carbon atoms.

11. The composition of claim 10 wherein said nonionic fabric softener is a diester of ethylene glycol and said fatty acid contains from about 16 to about 20 carbon atoms.

12. The composition of claim 1 packaged in a box formed from a material comprising cardboard.

13. The process of preparing an aqueous liquid concentrate fabric softener composition comprising adding from about 2% to about 30% of the composition of claim 1 to water at a temperature of from about 20° C. to about 80° C.

14. The process of claim 13 wherein said granular composition has an average particle diameter of between about 50 and about 800 microns.

15. The process of claim 14 wherein said particle diameter is between about 50 and about 400 microns.

16. The process of claim 13 wherein said nonionic fabric softener is a fatty acid ester of a polyhydroxy alcohol, or anhydride thereof, where said alcohol contains from 2 to about 12 carbon atoms and said fatty acid contains from about 12 to about 30 carbon atoms.

17. The process of claim 16 wherein said nonionic fabric softener is a sorbitan mono-, di-, and/or tri- ester and said fatty acid contains from about 16 to about 20 carbon atoms.

18. Particulate fabric softener composition which forms a finely divided dispersion within about thirty minutes when added to water having a temperature of no more than about 80° with minimal agitation, said composition comprising homogeneous particles containing:

A. from about 20% to about 95% of nonionic fabric softener material, wherein said nonionic fabric softening material is selected from the group consisting of:

i. Fatty acid ester of polyhydroxy alcohol, or anhydride thereof, said alcohol containing from 2 to about 18 carbon atoms and said fatty acid contains from about 12 to about 30 atoms;

ii. Ion pair of anionic detergent surfactants and fatty amines, or quaternary ammonium derivatives thereof, said ion pair being essentially nonionic and containing at least two long hydrophobic alkyl chains;

iii. Fatty alcohols, fatty acids, or lower alkoxylates or esters thereof wherein the fatty moiety contains from about 16 to about 30 carbon atoms; and iv. Mixtures thereof; and B. from about 5% to about 50% of a material that is cationic under conditions of use at dilute concentrations of said composition, said cationic material having a single long alkyl chain containing from about 12 to about 30 carbon atoms, said composition containing no more than 5% perfume.

* * * * *